US009200220B2

(12) United States Patent
Degenkolb et al.

(10) Patent No.: US 9,200,220 B2
(45) Date of Patent: Dec. 1, 2015

(54) IN-LINE GASIFIER HAVING A COOLING JACKET WITH PIPEWORK PASSING THROUGH THE SIDE OF THE PRESSURE CLADDING

(75) Inventors: Dietmar Degenkolb, Freiberg (DE); Frank Hannemann, Freiberg (DE); Horst Hoppe, Chemnitz (DE); Tino Just, Freiberg (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 510 days.

(21) Appl. No.: 13/569,302

(22) Filed: Aug. 8, 2012

(65) Prior Publication Data

US 2013/0039818 A1 Feb. 14, 2013

(30) Foreign Application Priority Data

Aug. 11, 2011 (DE) ..... 10 2011 080 838

(51) Int. Cl.

| | |
|---|---|
| ***C10J 3/76*** | (2006.01) |
| ***C10J 3/20*** | (2006.01) |
| ***C10J 3/46*** | (2006.01) |
| ***C10J 3/48*** | (2006.01) |
| ***C10J 3/74*** | (2006.01) |
| ***C10J 3/86*** | (2006.01) |
| ***C10J 3/78*** | (2006.01) |

(52) U.S. Cl.

CPC .... *C10J 3/20* (2013.01); *C10J 3/46* (2013.01); *C10J 3/48* (2013.01); *C10J 3/485* (2013.01); *C10J 3/74* (2013.01); *C10J 3/76* (2013.01); *C10J 3/78* (2013.01); *C10J 3/86* (2013.01); *C10J 2300/093* (2013.01); *C10J 2300/0956* (2013.01); *C10J 2300/0959* (2013.01)

(58) Field of Classification Search

USPC ..... 48/127.1, 127.9, 61, 76, 67, 69, 200, 48/201, 202, 203, 204, 71, 72, 73, 74, 210, 48/212, 213, 117, 95

See application file for complete search history.

(56) References Cited

U.S. PATENT DOCUMENTS 4,422,387 A * 12/1983 Brady et al. ..... 110/173 R
4,768,470 A * 9/1988 Ziegler ..... 122/7 R

FOREIGN PATENT DOCUMENTS

| | | | |
|---|---|---|---|
| CN | 101392189 | A | 3/2009 |
| CN | 101392190 | A | 3/2009 |
| CN | 101835879 | A | 9/2010 |
| DE | 2935771 | A | 5/1980 |
| DE | 145024 | A3 | 11/1980 |
| DE | 4017219 | A1 | 12/1991 |
| DE | 202008016515 | U | 3/2009 |
| DE | 202009012134 | U1 | 11/2009 |

* cited by examiner

*Primary Examiner* — Kaity Handal

(57) ABSTRACT

For an in-line gasifier having a liquid cooled cooling jacket it is proposed to lead the inlet connectors and the outlet connectors for the cooling liquid through the side of the cylindrical pressure vessel, below the mounting flange for the vessel cover. This achieves a simplification in the mounting of the pressure vessel cover. Particular embodiments concern the bringing together of the upper ends and of the lower ends of several pipe runs coiled in parallel, in each case into a collector pipe which has a connector bush for cooling water.

4 Claims, 2 Drawing Sheets

IN-LINE GASIFIER HAVING A COOLING JACKET WITH PIPEWORK PASSING THROUGH THE SIDE OF THE PRESSURE CLADDING

CROSS REFERENCE TO RELATED APPLICATIONS

This application claims priority of German application No. 10 2011 080838.8 DE filed Aug. 11, 2011. All of the applications are incorporated by reference herein in their entirety.

FIELD OF INVENTION

A reactor for gasifying carbon-containing slag-forming fuels, using a gasification agent containing free oxygen, in-line in the flow at pressures of up to 10 MPa, with simplified mounting of the pressure vessel cover is provided.

BACKGROUND OF INVENTION

For gasifiers for in-line gasification of slag-forming fuels, a known possibility is to delimit the reaction space by a multi-start spiral shaped coiled pipe diaphragm wall, also referred to as a cooling jacket. The cooling water which flows through the cooling jacket is fed in and out via connectors which are connected to the cover of the gasifier (FIG. 1). DE 202009012134 discloses an appropriate construction with four cooling water inlets and four cooling water outlets.

The increasing number of coils for larger gasifier capacity requires more connectors, which it is either impossible or illogical to arrange on the head of the vessel because of space limitations. Total emptying for the purpose of avoiding freezing up is not possible.

The nominal size of the cooling water pipes represents a further limiting factor in the dimensioning of the cooling jacket. As the reaction space is enlarged, with the objective of raising the capacity, the heat exchange area increases, with the result that a larger quantity of water is required to dissipate the amount of heat. An enlargement of the nominal size of the pipe diameter has the observable disadvantage that, on the one hand, the molten slag flows away less well at the tube wall and, on the other hand, the slag formation becomes less uniform, and overall becomes worse. Uniform slag formation is necessary in order to avoid local overheating and damage to the cooling jacket. As the nominal size is increased, a lower percentage of the water volume participates in the direct heat exchange, which can also promote local overheating.

The cooling water cannot be completely removed by the usual measures, such as draining off or "blowing out" using compressed air, so that in winter it is necessary to keep the circuit, the vessel, or its surroundings frost-free when taken out of service.

Inspection of the cooling jacket gap, or its replacement, involves extensive work, tests and dismantling, in particular at the connector bushes through the vessel's pressure shell. The challenge consists in being able to mount the upper vessel cover, which involves the demanding threading in of the forward and return flow pipes and making of the final welded seams with restricted ability to test them (vessel pressure testing). It is conventional, in accordance with the regulations (AD, ASME), that no more welding work is carried out after the vessel pressure testing.

Until now, when the gasifier capacity is increased the nominal size of the cooling jacket pipes has been increased, for the purpose of carrying away the additional quantities of heat.

A problem is that of designing an in-line gasifier with a liquid-cooled cooling jacket in such a way as to simplify the way the pressure vessel cover is mounted.

SUMMARY OF INVENTION

This problem is solved by an in-line gasifier having a cooling jacket with the features of the claims.

The elimination of the cover bushing for the cooling pipes substantially reduces the mounting and maintenance effort when replacing the cooling jacket. Furthermore, all the welded seams can be tested and extensive special quality assurance measures are eliminated. Another advantage is the better accessibility for inspections of the gap between the cooling jacket and the pressure vessel.

In a particular embodiment, the individual pipe runs are joined at their lower ends to a connector bush (19), which forms a pressure-tight passage through the pressure cladding. This measure makes it possible to completely empty the cooling jacket, when it is out of service, whereby the risk of destruction from sub-zero temperatures is eliminated, or on the other hand it is possible to dispense with the expense of keeping it warm or the use of antifreeze agents.

In one particular embodiment, the lower ends of several parallel pipe runs are joined to a common distributor ring (6), which is arranged in the lower region of the cooling jacket (14) and which is joined to a connector bush (19) which forms a pressure-tight passage through the pressure cladding. In one particular embodiment, the upper ends of several parallel pipe runs are joined to a common collector ring, which is arranged in the upper region of the cooling jacket (13) and which is joined to a connector bush (20) which forms a pressure-tight passage through the pressure cladding below the cladding flange (2). The inventive measures permit the construction of gasifiers with a high capacity with a limited nominal size of cooling jacket pipes and a reduced number of connectors through the pressure vessel. In addition, they make it possible to increase the number of starts, pipe runs and turns. The limitation of the nominal size of pipe leads at the same time to a limitation in the pipe wall thickness, and hence an improvement in the heat transfer.

Advantageous developments are specified in the sub-claims

Figure 1:
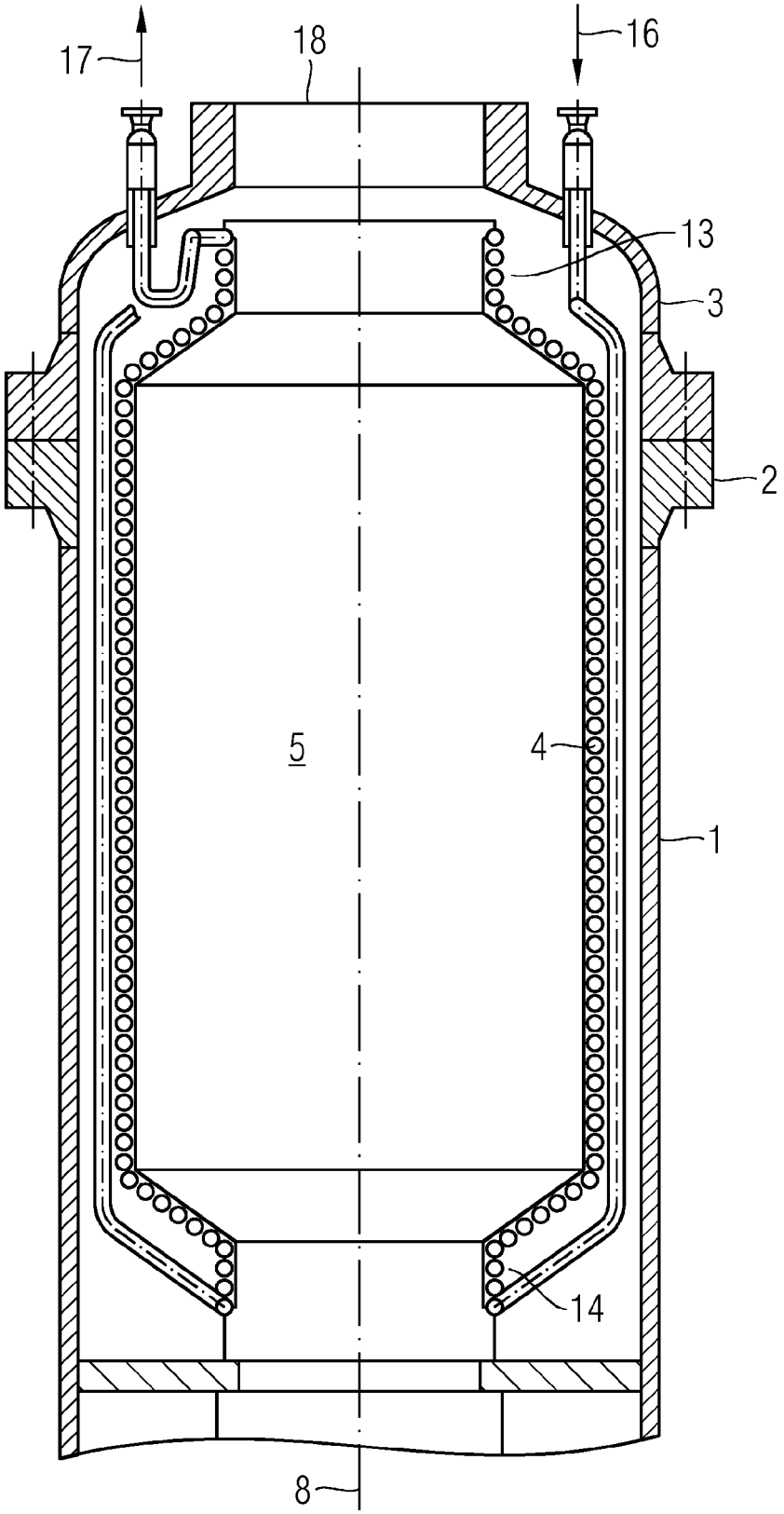
FIG. 1 a conventional gasification reactor with cooling water being fed in and away through the cover of the pressure housing, and FIG. 2 a gasification reactor, with cooling water being fed in and away through the pressure cladding.

In the figures, elements which are the same have the same labels.

DETAILED DESCRIPTION OF INVENTION

The reaction space (5) of a gasification reactor operating under a gasification pressure of up to 10 MPa (100 bar) is bounded by a cooling jacket (4), which is sheathed in a pressure cladding (1). At the head of the device is located the base of the gasification burner (18), through which are fed in the reaction media, fuel and gasification agents containing free oxygen. The gasified gas and the molten slag, which is formed from the fuel ash at the gasification temperature of between 1,200 and 1,900° C., are tapped off through the opening (11). Between the pressure cladding and the cooling jacket is the cooling jacket gap (12). The upper part (13) and lower part (14) of the cooling jacket are tapered. The cooling jacket (4) is coupled to a cooling water inlet (16) and a cooling water outlet (17).

The cooling water, which is heated in the cooling jacket, is fed away as hot water and is cooled, making use of its heat content, and fed back to the cooling jacket again as cooling water. The water pressure in the cooling jacket is kept a few tenths of an MPa (a few bar) above the gasification pressure in the reaction space. The cooling jacket is formed of several, generally n, pipe runs wound in parallel, which are described as an n-filament coil. In a preferred embodiment, the cooling jacket has six pipe runs wound in parallel, forming a six-start coil. The lower ends of the individual pipe runs are joined to a connector bush (19) arranged at the level of the lower part of the cooling jacket, which forms a pressure-tight passage through the pressure cladding, the connector bushes being distributed around the perimeter of the cylindrical pressure cladding.

The upper ends of the individual pipe runs are joined to a connector bush (20), which forms a pressure-tight passage through the pressure cladding below the pressure cladding flange (2), the connector bushes being distributed around the perimeter of the cylindrical pressure cladding.

The pressure-tight bushing of the inlet and outlet pipes is effected through packed gland seals (19 and 20 respectively).

In order to accommodate heat expansion during the start-up and shut-down processes, the inlet and outlet pipes are constructed and use bends which form an offset to permit movement.

In order to avoid local overheating of the cooling jacket, the number of pipes is increased (multi-starting) as the gasifier capacity is increased. By this means, the nominal size is limited. Since a higher number of pipes would imply a larger number of connectors through the pressure vessel, the number is reduced to 1-2 connectors (16) and connector bushes (19) on the input side by the arrangement of an inner annular pipe (6) in the lower region. In order to ensure complete emptying of the cooling jacket, the annular pipe and its connectors are arranged at the lowest point on the cooling jacket. The ability to empty it completely provides security against destruction if the temperature is below 0° C. when taken out of service.

Figure 2:
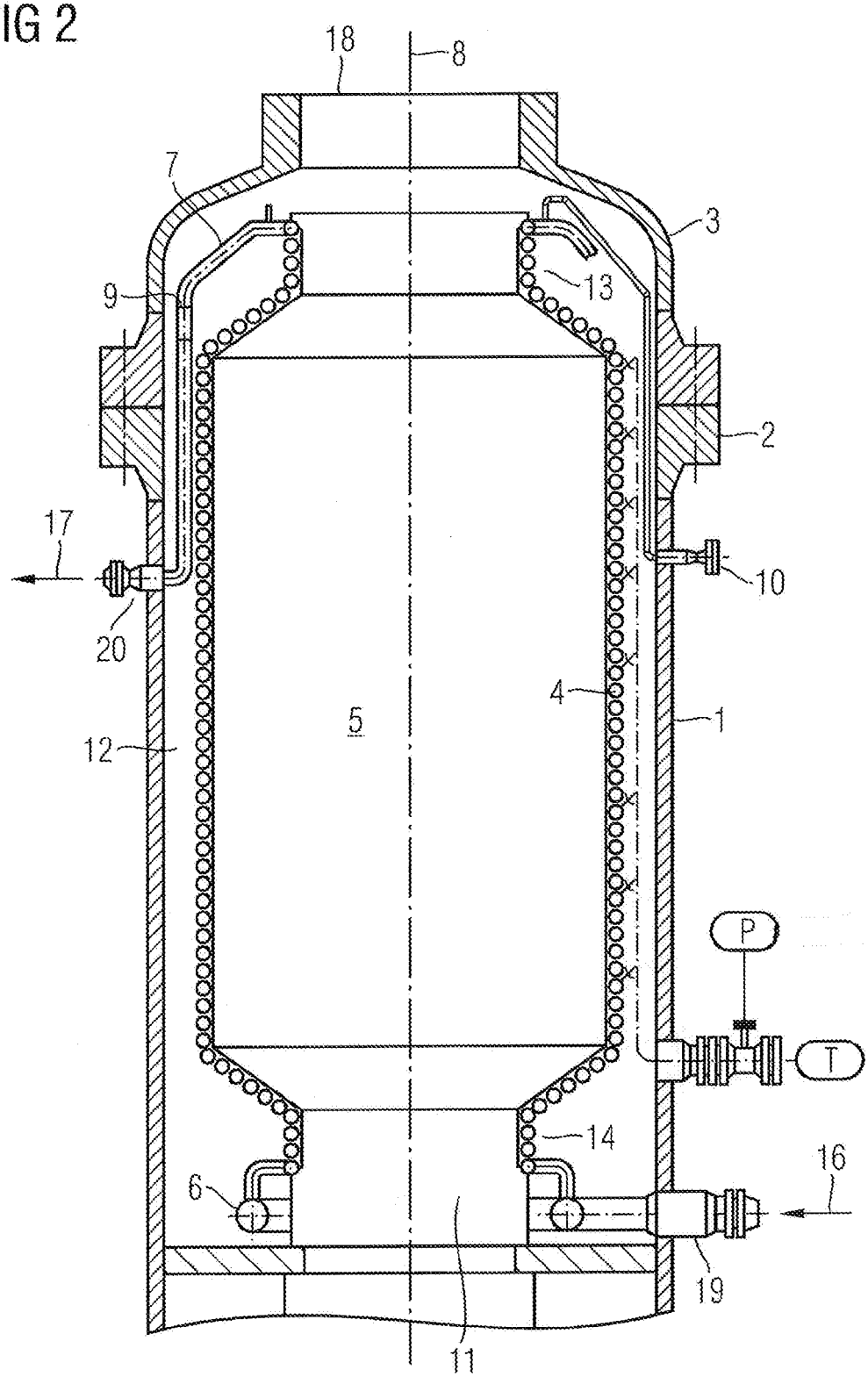

The upper ends of the individual pipe runs are connected to a separate connector bush (20), which forms a pressure-tight passage through the pressure cladding (1). At the highest point on the upper end of a pipe run is an air bleed line (10), the other end of the air bleed line (10) is a pressure-tight passage positioned through the pressure cladding (1) below the cladding flange (2), via a connector bush. The arrangement of the return flow bushes below the main flange on the cylindrical pressure cladding obviates expensive work on the vessel cover. The final mounting seams (9), required during mounting and replacement of the cooling jacket, lie in the easily accessible region above the cladding flange (see FIG. 2). This substantially simplifies the mounting and maintenance work, and testability is improved.

As another variant, it can be logical to feed all the return flows to one inner collector, which reduces the number of bushes through the pressure cladding (collector pipe or annular pipe, as applicable).

We claim:

1. A reactor for gasifying carbon-containing fuels, using a gasification agent containing free oxygen, in-line in the flow at pressures of up to 10 MPa, comprising:

a cooling jacket in a pressure cladding delimiting a reaction space, wherein the cooling jacket is formed by a plurality of coils of a pipe through which flows a cooling liquid, wherein the cooling jacket includes several runs of piping which are coiled parallel to one another, wherein the pressure cladding is closed off in the upper region of the cooling jacket by a removable vessel cover over a cladding flange, wherein the lower ends of the individual pipe runs are joined to a connector bush for the cooling fluid, which in the lower region of the cooling jacket forms a pressure-tight passage through the pressure cladding, wherein the upper ends of the individual pipe runs are joined to a connector bush for the cooling fluid, which forms a pressure-tight passage through the pressure cladding below the cladding flange, wherein the upper ends of the individual pipe runs are connected to a separate connector bush, which forms a pressure-tight passage through the pressure cladding, wherein connected at the highest point on the upper end of a pipe run is an air bleed line, the other end of the air bleed line having a pressure-tight passage through the pressure cladding below the cladding flange, via a connector bush, and wherein final mounting seams, required during mounting and replacement of the cooling jacket, lie in the region above the cladding flange.

2. The reactor as claimed in claim 1, wherein at the lower end of the cooling jacket there is a lower distributor pipe, arranged essentially concentrically about the vertical central axis of the reactor, wherein the individual pipe runs are joined by their lower ends to the lower distributor pipe, and wherein the lower distributor pipe is joined to a connector bush, which forms a pressure-tight passage through the pressure cladding.

3. The reactor as claimed in claim 1, wherein the connector which is joined to the lower end of a pipe run forms the inlet for cooling liquid, and the connector which is joined to the upper end of a pipe run forms the outlet for cooling liquid.

4. The reactor as claimed in claim 1, wherein the cooling jacket is formed by a six-start coil of six parallel pipe runs.

* * * * *